US007765906B2

(12) United States Patent
Ueno

(10) Patent No.: US 7,765,906 B2
(45) Date of Patent: Aug. 3, 2010

(54) METHOD OF FORMING THROUGH-HOLE AND THROUGH-HOLE FORMING MACHINE

(76) Inventor: Eizou Ueno, 5-9, Sumisaka 5-chome, Suzaka-shi, Nagano 382-0099 (JP)

( * ) Notice: Subject to any disclaimer, the term of this patent is extended or adjusted under 35 U.S.C. 154(b) by 430 days.

(21) Appl. No.: 11/287,346

(22) Filed: Nov. 28, 2005

(65) Prior Publication Data

US 2006/0123872 A1 Jun. 15, 2006

(30) Foreign Application Priority Data

Dec. 15, 2004 (JP) ..... 2004-362305

(51) Int. Cl.
*B23D 21/14* (2006.01)

(52) U.S. Cl. ..... 83/54; 83/185; 83/178

(58) Field of Classification Search ..... 83/13, 83/178, 188, 54, 49, 39, 185
See application file for complete search history.

(56) References Cited

U.S. PATENT DOCUMENTS

| | | | | |
|---|---|---|---|---|
| 2,204,273 | A * | 6/1940 | Hale | 83/164 |
| 5,666,840 | A | 9/1997 | Shah et al. | |
| 5,765,420 | A * | 6/1998 | Schaefer | 72/55 |
| 6,032,559 | A * | 3/2000 | Dean, Jr. | 83/191 |
| 6,341,549 | B2 * | 1/2002 | Kim | 83/99 |
| 6,718,860 | B2 * | 4/2004 | Mitsukawa et al. | 83/862 |

FOREIGN PATENT DOCUMENTS

| | | | |
|---|---|---|---|
| DE | 94 20 115.3 | U1 | 4/1995 |
| DE | 195 13 519 | A1 | 5/1996 |
| EP | 0 726 824 | B1 | 7/1998 |
| EP | 0 995 513 | A1 | 4/2000 |
| FR | 1.498.792 | | 10/1967 |
| JP | 5-42330 | A | 2/1993 |
| JP | 2000-301261 | A | 10/2000 |

* cited by examiner

*Primary Examiner*—Kenneth E. Peterson
*Assistant Examiner*—Sean Michalski
(74) *Attorney, Agent, or Firm*—Muncy, Geissler, Olds & Lowe, PLLC

(57) ABSTRACT

The method of forming a through-hole is capable of preventing formation of burrs, improving machining efficiency and reducing machining cost. The method of forming a through-hole in a circular wall of a cylindrical part of a work piece comprises the steps of: setting the work piece in a die; inserting a punch, which is provided to a rod-shaped metal core and whose length projected from the metal core is shorter than thickness of the circular wall, into the cylindrical part; relatively pressing and moving the punch toward the die so as to drive the punch into an inner face of the circular wall and bore the through-hole; sucking a scrap, which is formed by boring the through-hole, via a discharge hole of the die.

3 Claims, 15 Drawing Sheets

111
104
105
151
103
131
132
133
130
131a
102
121
S1

112
106
161
152
103
132
162
105
104
102
121
126
101
S2

113
106
153
103
132
162
105
104
102
121
128
101
110
S3

METHOD OF FORMING THROUGH-HOLE AND THROUGH-HOLE FORMING MACHINE

BACKGROUND OF THE INVENTION

The present invention relates to a method of forming a through-hole and a through-hole forming machine, more precisely relates to a method of forming a through-hole in a circular wall of a cylindrical part of a work piece and a through-hole forming machine capable of performing the method.

Conventionally, through-holes are formed in work pieces by drill means, die-punch press means, electric spark means, etc. To form a through-hole in a circular wall of a cylindrical part of a work piece, e.g., pipe, the above described means have been used.

However, by using the drill means an the press means, burrs are formed along edges of through-holes, so they must be removed. Especially, in case of forming a thorough-hole from an outer face of the cylindrical part by the drill means or the press means, burrs are formed along an inner edge of the through-hole. If the work piece is small, it is difficult to remove burrs formed in the cylindrical part of the work piece. Further, in some work pieces, it is impossible to remove burrs.

Conventionally, in case of forming a through-hole in a relatively thick circular wall of a cylindrical part of a small work piece, the electric spark means has been used.

However, it takes a long time to form the through-hole by the electric spark means, so manufacturing efficiency must be lower. Further, machining cost must be increased.

In the mean time, a through-hole can be formed in a flat work piece by the press means as shown in FIGS. 20(*a*) and 20(*b*). The method is disclosed in Japanese Patent Gazette No. 5-42330 (paragraphs [0005], [0006], [0009] and [0019]).

In the method, circular grooves 174*a*, which correspond to an edge of a through-hole 170*a* to be formed, is previously formed in at least a bottom face of a flat work piece 107*b*, then a pierce punch 151*a*, which is arranged to correspond to the circular grooves 174*a*, is driven into the work piece 107*b*, so that the through-hole 170*a* can be bored. Note that, a symbol 178*a* stands for a scrap, which is a part of the work piece 107*a* separated by boring the through-hole 170*a*.

However, in the method shown in FIGS. 20(*a*) and 20(*b*), the punch 151*a* is merely driven into a die 151*b* from an upper side. This method cannot be applied to form a through-hole in a circular wall of a cylindrical part of a small work piece.

Thus, workers have tried to bore a through-hole, by a punch, from the inside of the cylindrical part so as not to form burrs therein. However, a small punch, which can be inserted into the cylindrical part, is required, and a span of life of the punch must be short. Namely, there is no punches having such function.

SUMMARY OF THE INVENTION

The present invention was invented to the problems of the conventional methods of forming a through-hole in a circular wall of a cylindrical part of a small work piece.

An object of the present invention is to provide a method of forming a through-hole, which is capable of preventing formation of burrs, improving machining efficiency and reducing machining cost.

Another object of the present invention is to provide a through-hole forming machine, which is capable of performing the method of the present invention.

To achieve the objects, the present invention has following structures.

Namely, the method of forming a through-hole in a circular wall of a cylindrical part of a work piece comprises the steps of:

setting the work piece in a die;

inserting a punch, which is provided to a rod-shaped metal core and whose length projected from the metal core is shorter than thickness of the circular wall, into the cylindrical part;

relatively pressing and moving the punch toward the die so as to drive the punch into an inner face of the circular wall and bore the through-hole;

sucking a scrap, which is formed by boring the through-hole, via a discharge hole of the die.

In the method, a concave, whose diameter is slightly greater than that of the through-hole, may be formed, at a predetermined position of boring the through-hole, in an outer face of the circular wall prior to boring the through-hole, and a break reaching an edge of the concave may be formed by driving the punch into the inner face of the circular wall.

In the method, the punch may be relatively pressed and moved toward the die by an elastic force.

The through-hole forming machine for forming a through-hole in a circular wall of a cylindrical part of a work piece comprises:

a die for holding the work piece;

a punch for boring the through-hole with the die, the punch being provided to a front end of a rod-shaped metal core, having a length, which is projected from the metal core, shorter than thickness of the circular wall, and being inserted into the cylindrical part; and a mechanism for relatively pressing and moving the punch toward the die so as to drive the punch into an inner face of the circular wall and bore the through-hole, and a rear end of the metal core is detachably attached to a block for holding the metal core.

In the machine, a front part of the metal core may be thinner than a rear part thereof so as to allow the punch to move toward the die in the cylindrical part, and a step-shaped border between the front part and the rear part may be rounded.

Another through-hole forming machine for forming a through-hole in a circular wall of a cylindrical part of a work piece comprises:

a die for holding the work piece;

a punch for boring the through-hole with the die, the punch being provided to a rod-shaped metal core, having a length, which is projected from the metal core, shorter than thickness of the circular wall, and being inserted into the cylindrical part; and a mechanism for relatively pressing and moving the punch toward the die so as to drive the punch into an inner face of the circular wall and bore the through-hole, and a front end face of the punch is chamfered along the inner face of the cylindrical part.

The both machines may further comprise means for sucking a scrap, which is formed by boring the through-hole, via a discharge hole of the die.

In the both machines, the sucking means may be a vacuum sucking device, which employs venture effect by flowing compressed air through a path having a broader sectional area.

In the both machines, the pressing mechanism relatively presses and moves the punch toward the die by an elastic force.

The work piece of the present invention has a cylindrical part and a through-hole formed in a circular wall of the cylindrical part, and the through-hole is formed by the machine of the present invention.

By the method and the machine of the present invention, forming burrs inside of the cylindrical part can be prevented, machining efficiency can be improved and machining cost can be reduced.

BRIEF DESCRIPTION OF THE DRAWINGS

Embodiments of the present invention will now be described by way of examples and with reference to the accompanying drawings, in which:

FIG. 5(*b*) is a bottom view of the punch;

DETAILED DESCRIPTION OF THE EMBODIMENTS

Preferred embodiments of the present invention will now be described in detail with reference to the accompanying drawings.

Figure 1:
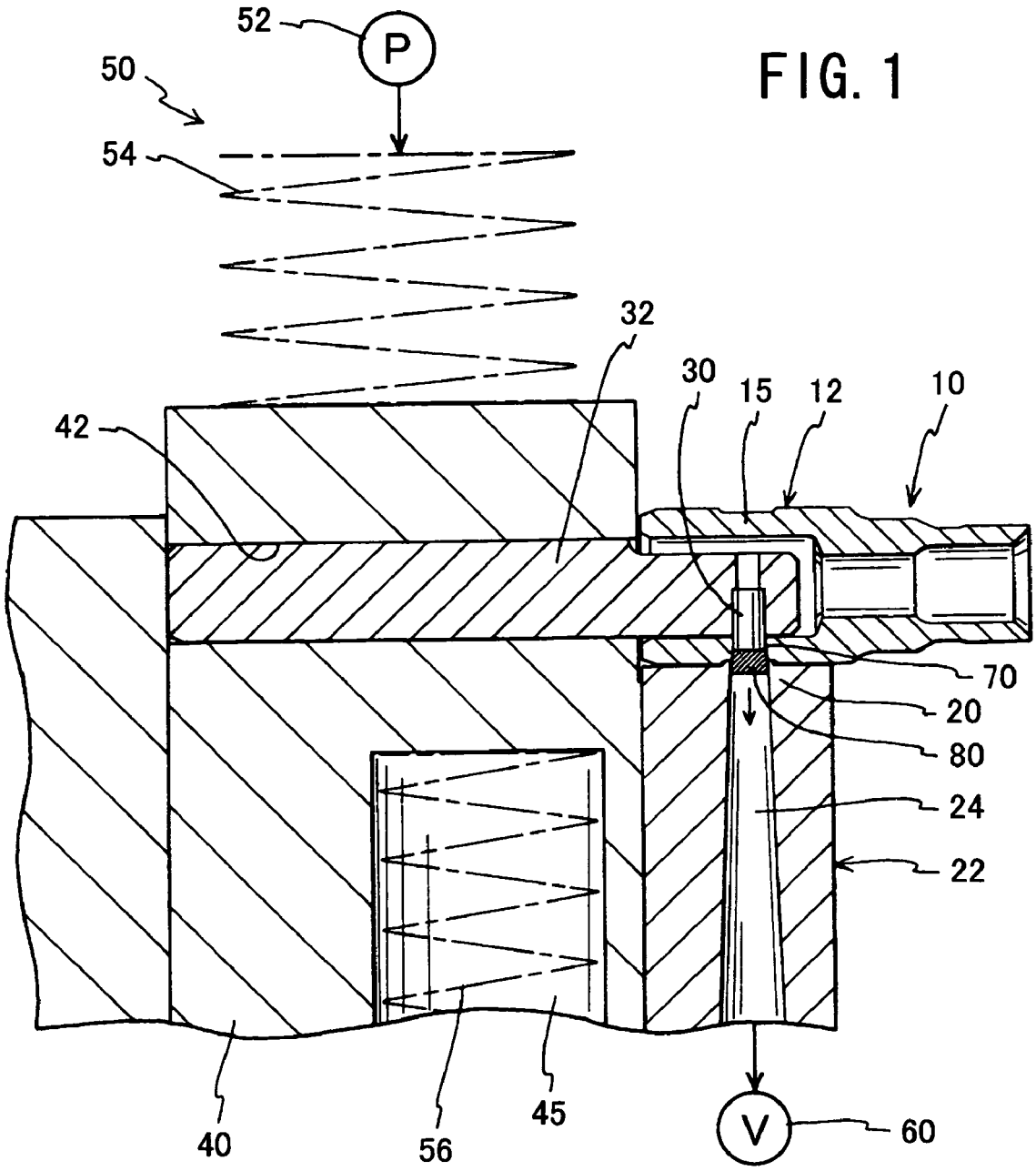
FIG. 1 is a sectional view of an embodiment of the through-hole forming machine of the present invention.
Figure 2:
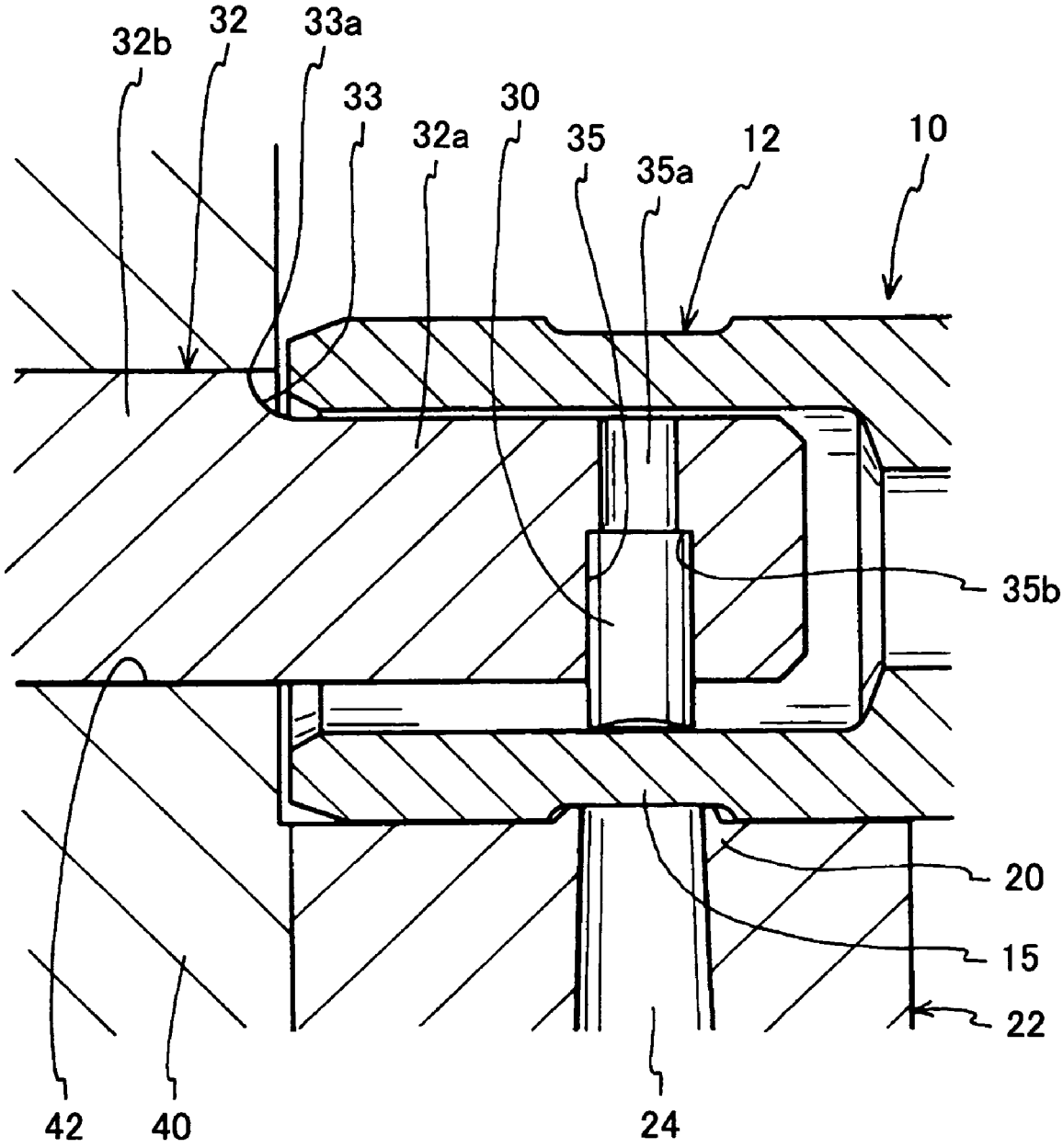
FIG. 2 is a sectional view showing a punch insertion process performed by the machine shown in FIG. 1.
Figure 3:
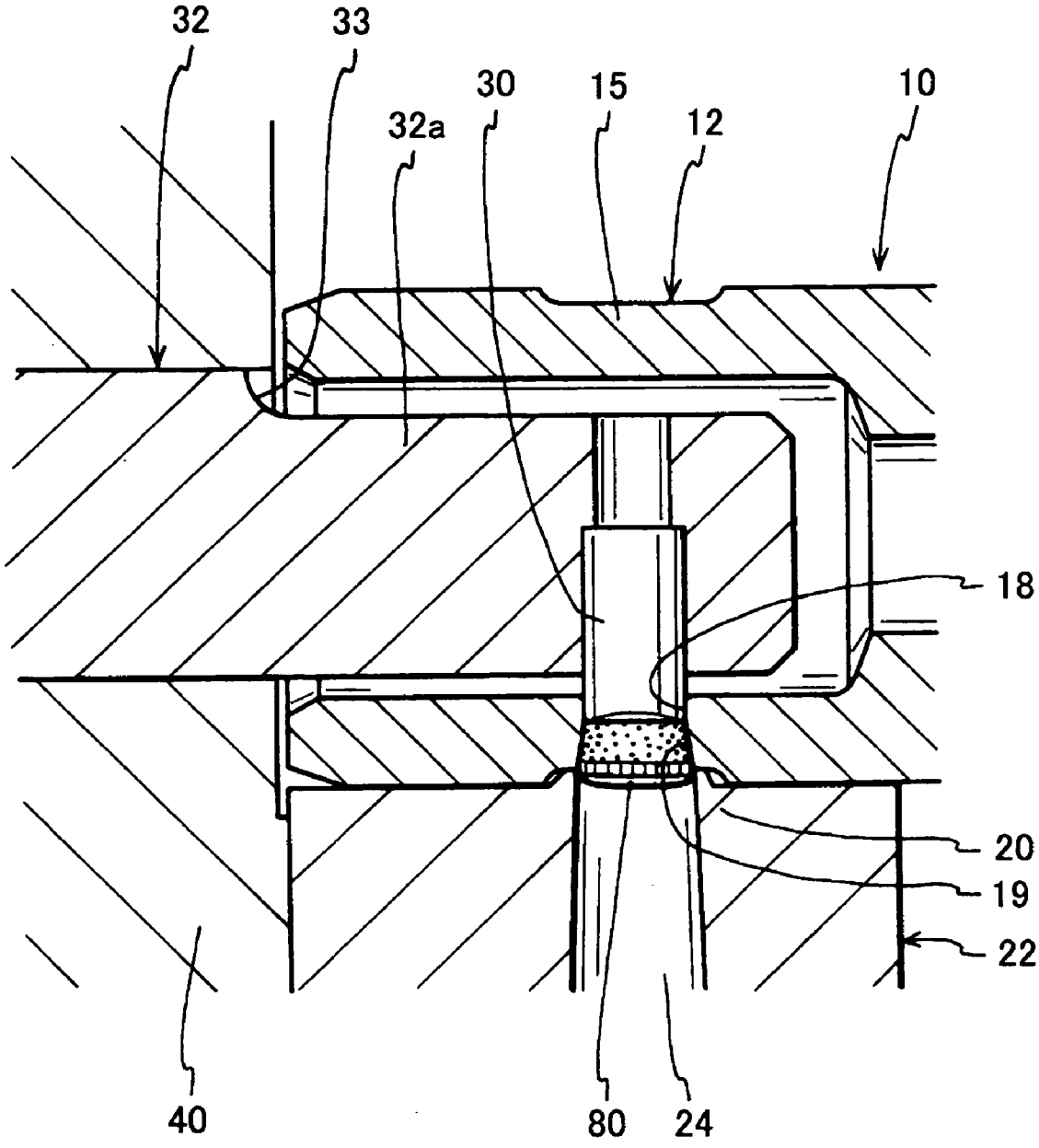
FIG. 3 is a sectional view showing a boring process performed thereby.
Figure 4:
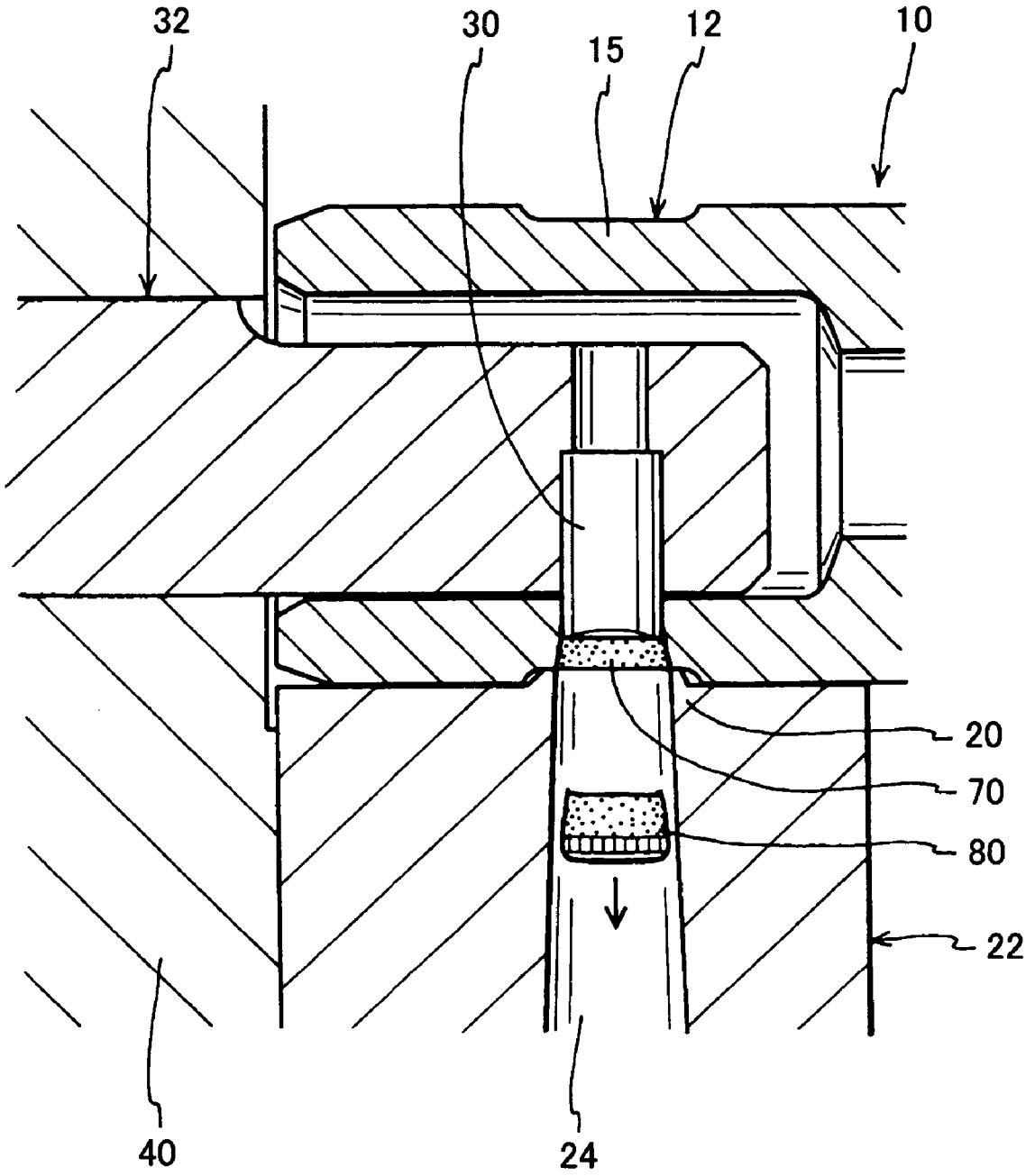
FIG. 4 is a sectional view showing a scrap discharge process performed thereby.
Figure 5A:
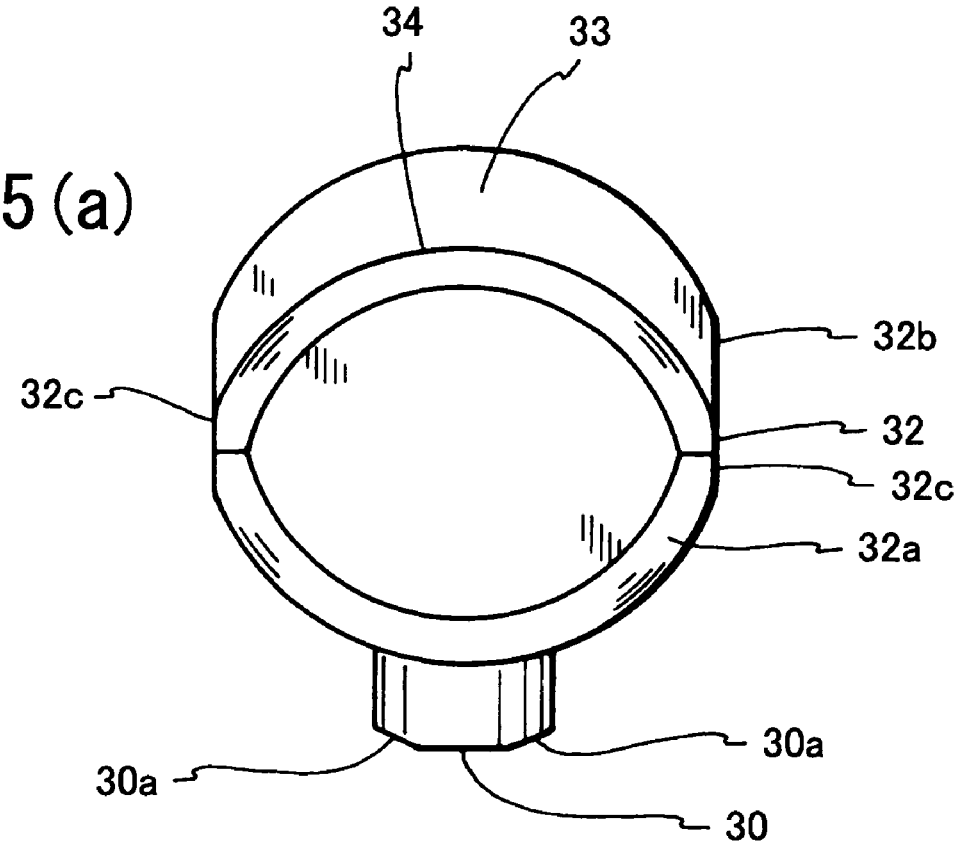
FIG. 5(*a*) is a front view of a punch.
Figure 5B:
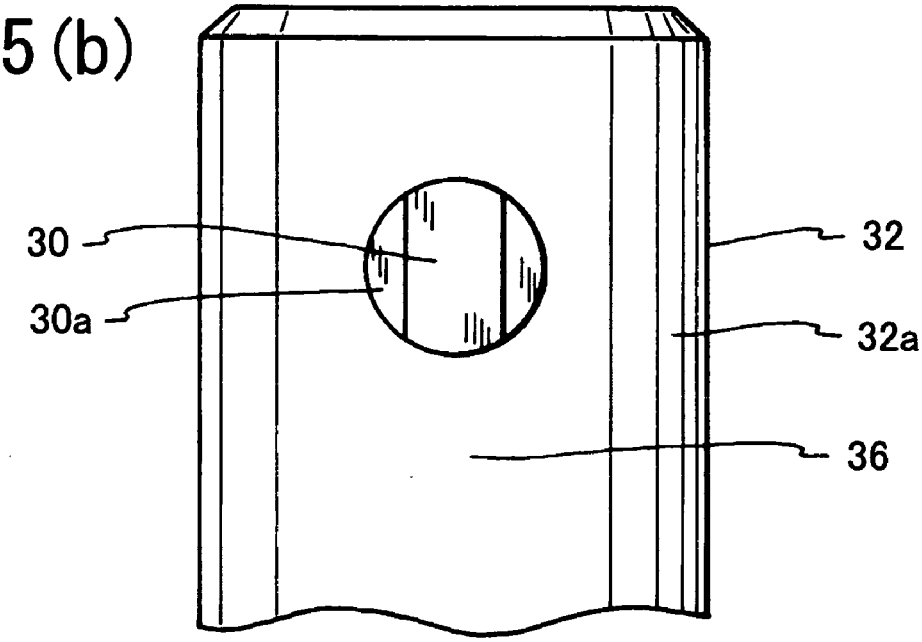
Figure 6:
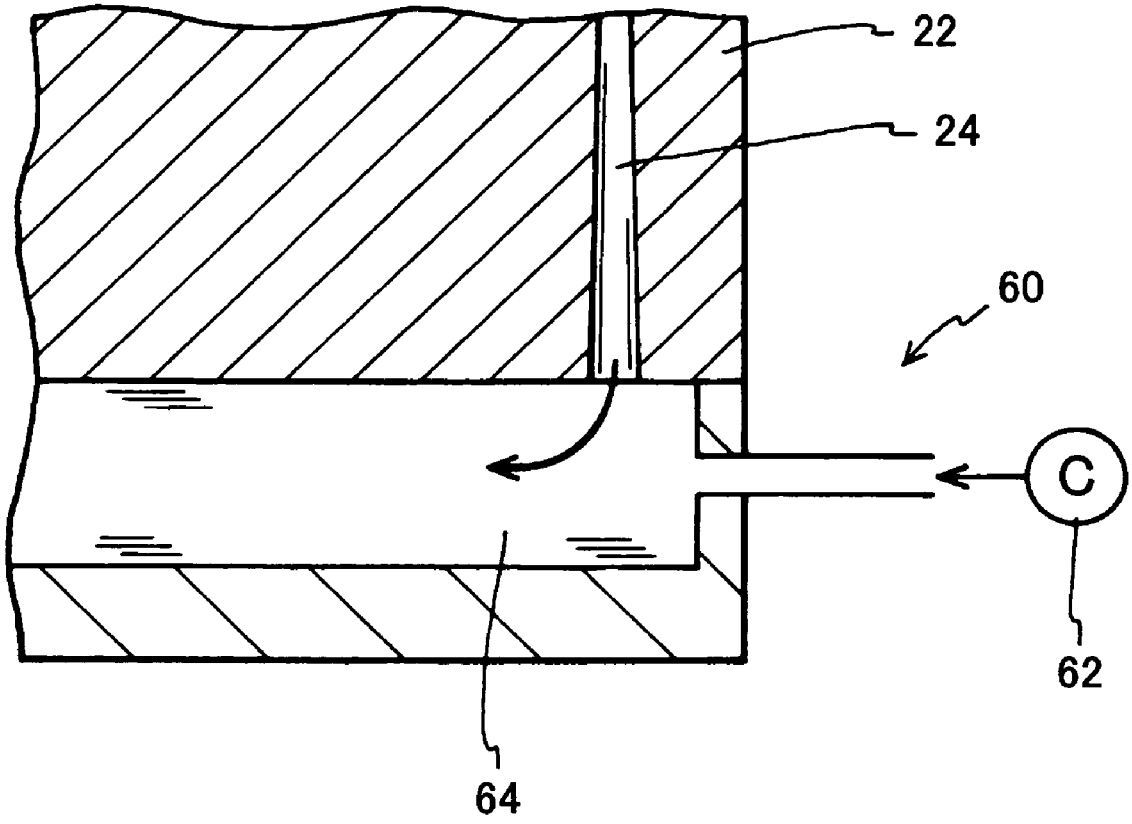
FIG. 6 is a sectional view of an example of a vacuum sucking device.

FIG. 1 is a sectional view of an embodiment of the through-hole forming machine of the present invention; FIGS. 2-4 are sectional views a boring process; FIG. 5(*a*) is a front view of a punch; FIG. 5(*b*) is a bottom view of the punch; and FIG. 6 is a sectional view of an example of a vacuum sucking device.

The through-hole forming machine of the present embodiment bores a through-hole in a circular wall of a cylindrical part of a work piece by press means.

A work piece 10 has at least one cylindrical part 12. For example, the work piece 10 is a metal cap of a hydraulic valve lifter and made by forging. An inner diameter of the work piece 10 is about 6.5 mm, and a thickness of a circumferential wall thereof is about 2 mm. In the present embodiment, the through-hole forming machine bores a through-hole 70, whose diameter is about 2 mm, in the work piece 10.

A die 20 is used for machining the work piece 10. An upper part of a die block 22 acts as the die 20, and the work piece 10 is mounted on a center part of the die 20 so as to bore the through-hole 70.

A discharge hole 24 for discharging a scrap 80 formed by boring the through-hole 70 is formed in the die block 22. An diameter of the discharge hole 24 is gradually made greater toward a lower end of the die block 22, so that the scrap 80 can be suitably discharged without blocking the discharge hole 24.

A punch 30 is provided to a free end (a front end) of a rod-shaped metal core 32, whose base end (rear end) is detachably attached to an elevating block 40, and projected downward. A length of the punch 30 projected from the metal core 32 is shorter than the thickness of the circumferential wall 15 of the work piece 10. In the present embodiment, the projected length of the punch 30 is about a half of the thickness of the circumferential wall 15 of the work piece 10. Since the punch 30 is short and the metal core 32 is thick, life spans of the die 30 and the metal core 32 can be made longer. A relief stroke of the punch 30 can be short, so that the metal core 32, which is inserted into the work piece 10, can be made thicker. Therefore, rigidity of the punch 30 and the metal core 32 can be improved, so that their life spans can be longer. By shortening the punch 30, damages of the punch 30 can be reduced. Machining efficiency can be improved, and machining cost can be highly reduced.

An upper end of the punch 30 is press-fitted in a through-hole 35 formed in the front end part 32*a* of the metal core 32 (see FIG. 2). The upper end of the punch 30 contacts a step part 35*b*, so that the projected length of the punch 30, which is downwardly projected from a bottom face 36 of the metal core 32 (see FIG. 5), is correctly defined.

A diameter of an upper part 35*a* of the through-hole 35 is shorter than that of a lower part thereof, in which the punch 30 is fixed. To exchange the punch 30, a rod-shaped tool is inserted into the upper part 35*a* to eject the punch 30 therefrom. Therefore, the punch 30 can be easily exchanged.

Note that, the punch 30 and the metal core 32 may be integrally formed.

As shown in FIGS. 1-4, the punch 30 is inserted in the cylindrical part 12 while the press-punching process. Note that, the work piece 10 may be conveyed, by a proper feeder, so as to cover the front end part 32*a* of the metal core 32 including the punch 30, so that the punch 30 can be relatively inserted in the cylindrical part 12.

As described above, the punch 30 is provided to the front end part 32*a*, and the rear end part 32*b* of the metal core 32 is horizontally fitted in a hole 42 of the elevating block 40. The metal core 32 is detachably attached to the elevating block 40. Note that, side faces 32*c* of the metal core 32 are formed into flat faces so as not to turn in the elevating block 40. The metal core 32 can be easily exchanged.

The free end part 32*a* of the metal core 32 is horizontally projected from the elevating block 40, and the metal core 32 is formed into the rod-shape. Therefore, a great moment is applied to the metal core 32 by a pressing force when the press-punching is performed. Thus, the metal core 32 is elastically bent upward by the pressing force.

When the through-hole 70 is bored, the bend is relieved at a dash. Namely, when the punch 30 breaks the circumferential wall 15 to bore the through-hole 70, a stress stored in the metal core 32 is relieved. Then, the metal core 32 is impactively bent downward by a force of relieving the stress. With this action, the punch 30 impactively presses the scrap 80 toward the discharge hole 24. Since the metal core 32 is fixed in the hole 42, this action can be effectively performed.

Even if the length of the punch 30 is shorter than the thickness of the work piece 10, the scrap 80 is flicked and the through-hole 70 can be suitably opened. As described above, the punch 30 is short so that the life span of the punch 30 can be made longer and the machining cost can be reduced.

As clearly shown in FIG. 2, the front end part 32*a* of the core metal 32, in which the punch 30 is fixed, is thinner than the rear end part 32*b* thereof. With this structure, the front end part 32*a* can be moved upward and downward, in the cylindrical part 12, together with the punch 30 so as to bore the through-hole 70. An upper face of the front end part 32*a* is cut to form a cut section 34 (see FIG. 5(*a*)). The cut width is equal to a stroke of the up-down movement of the metal core 32. An upper face of the cut section 34 is formed into a circular face along the inner circumferential face of the cylindrical part 12. With this structure, the metal core 32 can be inserted into a limited inner space of the cylindrical part 12 and moved upward and downward. Further, sectional area of the metal core 32 can be broader, so that the rigidity of the metal core 32 can be higher.

A step-shaped border 33 between the front end part 32*a* and the rear end part 32*b* is rounded. In the present embodiment, as shown in FIGS. 1-4, the step-shaped border 33 is formed on the upper side of the metal core 32, and stress is dispersed by rounding the step-shaped border 33 so that stress concentration can be prevented.

An upper corner 33*a* of the step-shaped border 33 is accommodated in the hole 42 of the elevating block 40. With this structure, a pressure applied to the metal core 32 can be suitably received by the elevating block 40.

Therefore, fatigue-fracture of the metal core 32 can be prevented, so that the life span of the metal core 32 can be made longer, the machining efficiency can be improved and the machining cost can be reduced.

By rounding the step-shaped border 33 and deeply inserting the metal core 32 in the elevating block 40, the elastic bend of the metal core 32 can be suitably used and the scrap 80 can be securely discharged.

Note that, the metal core 32 should have at least the front end part 32*a*, which can be inserted into the cylindrical part 12 of the work piece 10. Therefore, the shape of the rear end part 32*b* is not limited. The metal core 32 of the present invention can be easily made and easily exchanged.

Pressing means 50 downwardly presses and moves the punch 30 toward the die 20 together with the metal core 32 so as to drive the punch 30 into the circumferential wall 15 of the cylindrical part 12 from inside. By this punching action, a sheared part 18 and a broken part 19 are formed in the circumferential wall 15 so that the through-hole 70 can be bored (see FIG. 3).

In the present embodiment, the punch 30 is moved downward together with the metal core 32, which is held by the elevating block 40. The punch 30 is driven in a direction perpendicular to the inner face of the circumferential wall 15.

A press unit 52 is, for example, a cylinder unit.

Elastic means 54, e.g., coil spring, is elastically provided between the press unit 52 and the elevating block 40 so as to apply an elastic force when the punch 30 is relatively moved with respect to the die 20.

An upper part of a return spring 56, e.g., coil spring, is accommodated in an accommodating space 45 or the elevating block 40; a lower end is held by a base board (not shown). With this structure, the return spring 56 returns the elevating block 40, the metal core 32 and the punch 30 to initial positions when the through-hole forming process is completed.

To suitably form the sheared part 18 and the broken part 19, a prescribed clearance should be formed between the die 20 and the punch 30. For example, in case of boring a circular through-hole in a work piece made of iron, the suitable clearance is determined on the basis of the following formula:

$$\text{(Inner diameter of the die)}=\text{(Outer diameter of the die)}+[\text{Thickness of the work piece}\times(5-10\%)]\times 2$$

In the present embodiment, the pressing means 50 includes the elastic means 54, so the pressure is gradually applied when the punch 30 contacts the inner face of the cylindrical part 12. Since applying an impactive pressure can be prevented, damages of the punch 30 can be prevented.

When the punch 30 bores the through-hole 70, the elastic force of the elastic means 54 is relieved at a dash, or rapidly. Namely, when the punch 30 breaks the circumferential wall 15 and completely bores the through-hole 70, the elastic means 54 is rapidly relieved and moves to the initial position. With this action, the punch 30 impactively pushes the scrap 80 toward the discharge hole 24. Even if the punch 30 is short, the scrap 80 can be securely removed by the elastic force as well as the bend of the metal core 32.

Therefore, the life span of the parts of the machine can be made longer, and the machining cost can be reduced.

As shown in FIG. 5(*a*), a lower end face of the punch 30, which acts as a cutting edge, is chamfered along the inner circumferential face of the cylindrical part 12 of the work piece 10.

In the present embodiment, two chamfered parts 30*a*, which correspond to the inner circumferential face of the cylindrical part 12, are formed on the right and the left sides of the punch 30.

By forming the chamfered parts 30*a*, the lower end of the punch 30 contacts the inner circumferential face of the cylindrical part 12 at a plurality of points, so that damages of the punch 30 can be prevented. Further, by forming the chamfered parts 30*a*, shearing angles are made as well as scissors, so that the pressing force can be suitably dispersed and the through-hole 70 can be suitably bored.

With this merit, the life span of the parts of the machine can be made longer, and the machining cost can be reduced.

By using the punch 30 having the chamfered parts 30*a*, no scrap sticks onto the lower end of the punch 30 so that the machining efficiency can be improved.

Sucking means 60 sucks and removes the scrap 80 via the discharge hole 24 of the die 20 when the through-hole 70 is bored, so that the through-hole 70 can be securely opened.

When the scrap 80 is formed, the sucking means 60 is sucking air so that the scrap 80 is sucked immediately after the scrap 80 is separated from the work piece 10. Therefore, the through-hole 70 can be securely opened without leaving the scrap 80.

As described above, the scrap 80, which has been impactively pushed out by the function of the elastic bend and the elasticity of the elastic means 54, is further sucked by the sucking means 60. With action, the scrap 80 can be securely separated from the work piece 10 and discharged outside via the discharge hole 24.

For example, a vacuum sucking unit shown in FIG. 6 may be used as the sucking means 60. In the vacuum sucking unit, compressed air is introduced into a wide path 64, whose sectional area is broader than that of the discharge hole 24, from a compressed air source 62 so that a negative pressure is generated in the discharge hole 24 by the venturi effect. By generating the negative pressure, the scrap 80 is sucked and removed via the discharge hole 24 and the wide path 64. By always forming the negative pressure, the scrap 80 can be immediately removed.

By using the above described sucking means, an ordinary compressor may be used as the compressed air source 62. Namely, the sucking means can be easily made. Note that, other sucking means, e.g., vacuum unit, pressure reduction unit, may be employed.

By examining the sheared part and the broken part, existence of the through-hole 70 in the circumferential wall 15 of the cylindrical part 12 of the work piece 10 can be known.

The through-hole forming machine of the present embodiment can suitably form the through-hole in a work piece having high brittleness, e.g., forged product.

Next, the process of boring the through-hole 70 in the circumferential wall 15 of the cylindrical part 12 of the work piece 10, which is performed in the above described through-hole forming machine, will be explained with reference to FIGS. 2-4.

Firstly, as shown in FIG. 2, the work piece 10 is mounted and set in the die 20, then the punch 30, whose length is shorter than the thickness of the circumferential wall 15 and which is provided to the free end part 32*a* of the metal core 32, is inserted into the cylindrical part 12.

Note that, the work piece 10 may be correctly positioned in the die 20 by ordinary means.

Then, the punch 30 is pressed and moved toward the die 20 together with the metal core 32 so as to drive the punch 30 into the inner face of the circumferential wall 15 of the cylindrical part 12 of the work piece 10. With this action, the sheared part 18 and the broken part 19 are formed from the inner face of the circumferential wall 15 to the outer face thereof. At that time, the punch 30 is located midway of the stroke and further driven into the wall 15 (see FIG. 3).

In the state shown in FIG. 3, by forming the broken part 19, the scrap 80 is just separated from the wall 15 of the work piece 10. The through-hole 70 is bored, but the scrap 80 is located in the through-hole 70. Note that, in the shown state, the through-hole 70 is completely bored.

When the scrap 80 is separated from the work piece 10, the pressing force of the punch 30 is relieved at a dash. Therefore, the punch 30 is moved downward at a dash by moving the punch 30 downward, relieving the elastic bend of the metal core 32 and the elasticity of the elastic means 54. With this action, the punch 30 is capable of rapidly pushing the scrap 80 into the discharge hole 24 of the die 20.

When the through-hole 70 is formed, the scrap 80 is sucked and removed, via the discharge hole 24 of the die 20, by the sucking means 60 so that the through-hole 70 can be completely opened.

As described above, at that time, the scrap 80 has been pushed downward, so the scrap 80 can be easily sucked. Therefore, the scrap 80 can be securely removed. Namely, the removing work need not be performed separately, so that the machining efficiency can be improved.

In the present embodiment, the punch 30 is driven into the inner face of the circumferential wall 15 to bore the through-hole, so that no burrs are formed in the cylindrical part 12.

Unlike the conventional press-punching machine, the punch 30 need not completely pierce the circumferential wall 15 of the work piece 10. Namely, in the present embodiment, the short punch 30, whose length is about a half of the thickness of the wall 15, is capable of completely boring the through-hole 70 and removing the scrap 80 therefrom.

Therefore, the life span of the parts of the machine can be made longer, the machining efficiency can be improved and the machining cost can be reduced.

Figure 7A:
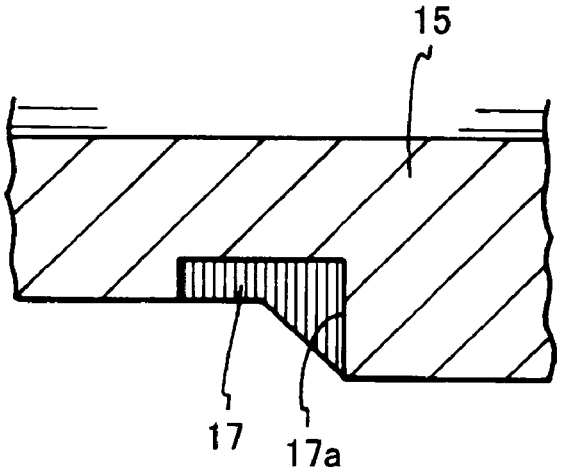
FIGS. 7(*a*)-7(*c*) are sectional views showing the boring process.
Figure 7B:
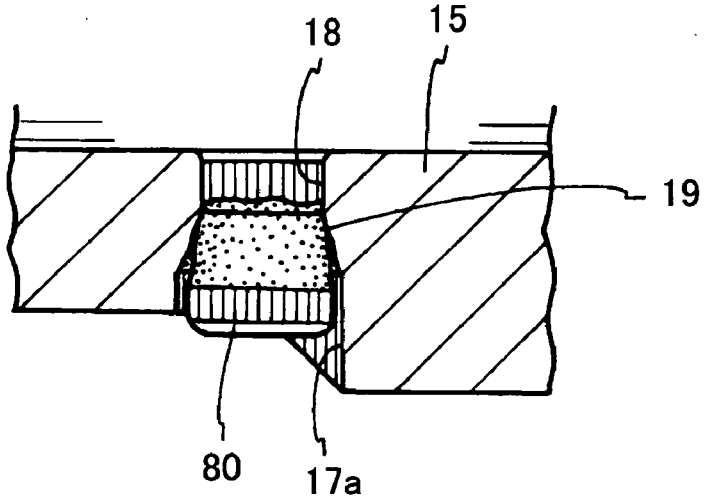
Figure 7C:
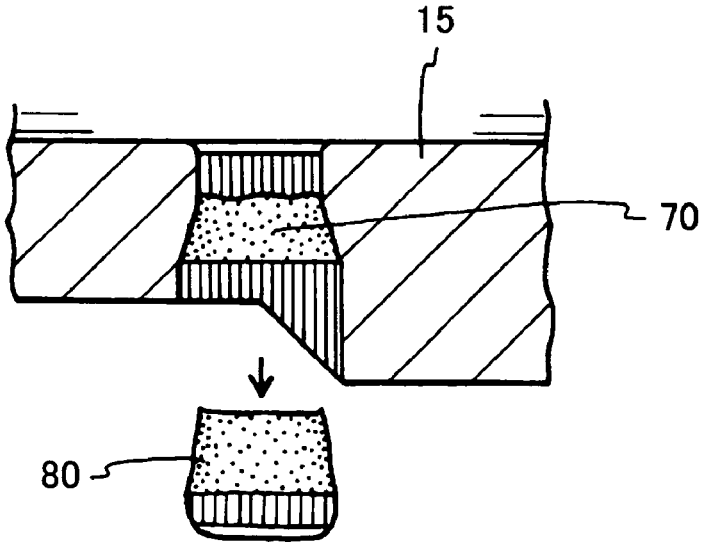

Successively, a method of boring the through-hole 70 in the circumferential wall 15 of the work piece 10 by a two-stage process with further reference to FIGS. 7(*a*)-7(*c*).

Firstly, as shown in FIG. 7(*a*), a concave 17, whose diameter is slightly greater than that of the through-hole 70, is formed, at a predetermined position of boring the through-hole 70, in the outer face of the cylindrical part 12 by a crushing punch (not shown) prior to boring the through-hole 70.

Then, the work piece 10 is set in the die 20, and the punch 30, whose length is shorter than the thickness of the circumferential wall 15 and which is provided to the free end part 32*a* of the metal core 32, is inserted into the cylindrical part 12 as shown in FIG. 2.

Next, the punch 30 is pressed and moved toward the die 20 together with the metal core 32 so as to drive the punch 30 into the inner face of the circumferential wall 15 of the cylindrical part 12 of the work piece 10 (see FIG. 3). With this action, the sheared part 18 and the broken part 19 are formed from the inner face of the circumferential wall 15 to an edge 17*a* of the concave 17 as shown in FIG. 7(*b*).

When the punch 30 reaches the stroke end, the scrap 80 is completely separated from the work piece 10 and rapidly discharged toward the discharge hole 24 by relieving the elastic bend of the metal core 32 and the elasticity of the elastic means 54 (see FIGS. 1-6).

Next, the scrap 80 is sucked and removed, via the discharge hole 24 of the die 20, by the sucking means 60 (see FIG. 4), so that the through-hole 70 is completely opened as shown in FIG. 7(*c*).

In this embodiment too, the scrap 80 is suitably discharged downward, so it can be easily sucked. Therefore, the scrap 80 can be securely removed.

By using the above described method, the through-hole 70 can be suitably bored in the thick wall 15. By previously forming the concave 17, no burrs are formed in not only the inner face of the cylindrical part 12 but also the outer face thereof. Therefore, a post process, e.g., barrel polishing process, can be omitted.

In this embodiment too, unlike the conventional press-punching machine, the punch 30 need not completely pierce the circumferential wall 15 of the work piece 10. Namely, the short punch 30, whose length is about a half of the thickness of the wall 15, is capable of completely boring the through-hole 70 and removing the scrap 80 therefrom. Further, no independent step of removing the scrap 80 is required.

Therefore, the life span of the parts of the machine can be made longer, the machining efficiency can be improved and the machining cost can be reduced.

Example 1

An example of the through-hole forming method performed by the through-hole forming machine will be explained.

Figure 19:
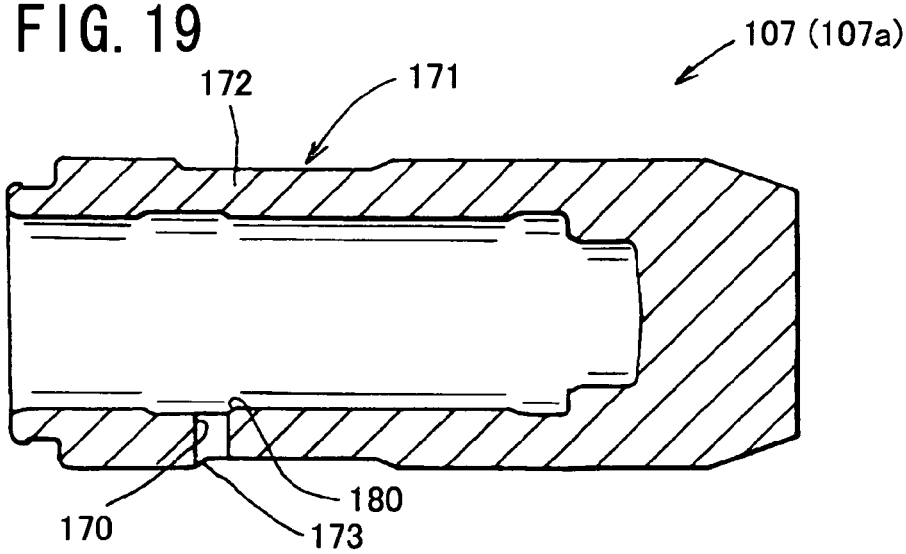
FIG. 19 is a sectional view of the work piece.
Figure 20A:
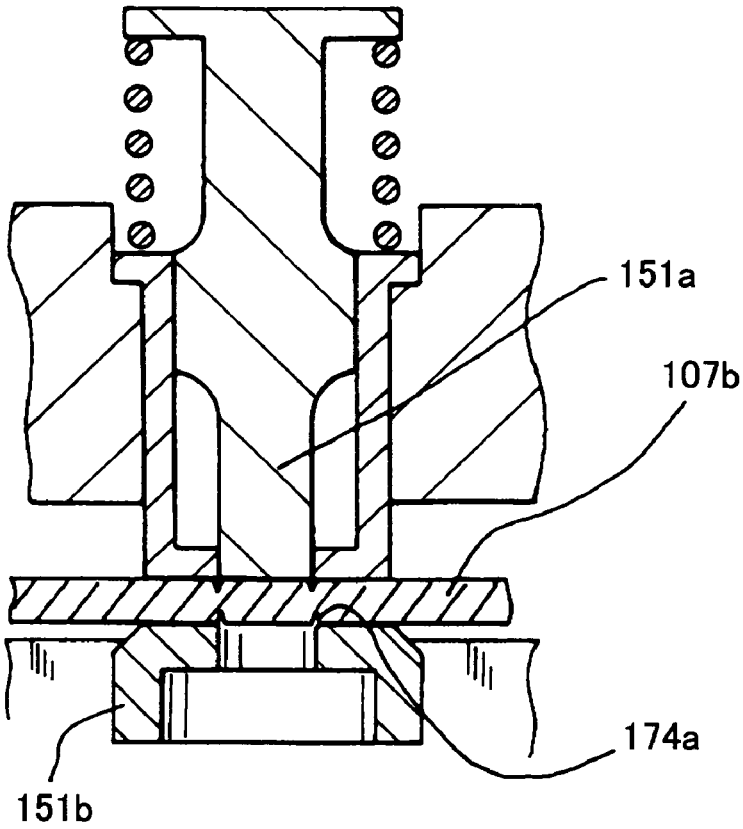
FIG. 20(a) PRIOR ART
FIGS. 20(*a*) and 20(*b*) are explanation views of the conventional through-hole forming machine.
Figure 20B:
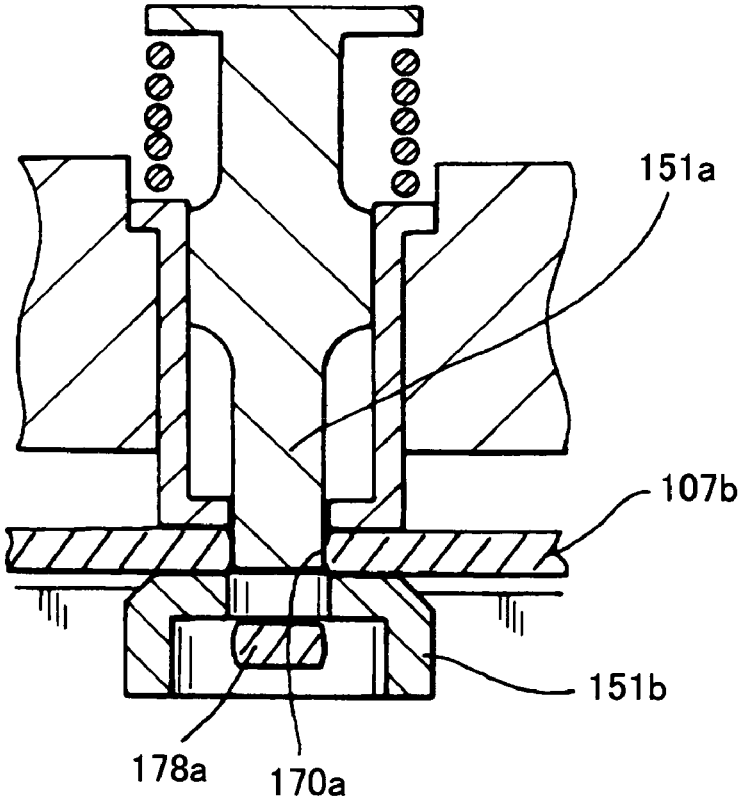
FIG. 20(b) PRIOR ART

A work piece 107 is a body 107*a* of the hydraulic valve lifter shown in FIG. 19. A through-hole 170 is bored in a circumferential wall 172 of a cylindrical part 171 of the body 107*a*. A front end of the cylindrical part 171 is closed.

A slope part 173, which is lowered toward the front end, is formed in the circumferential direction. The through-hole 70 will be bored in the slope part 173.

An outer diameter of the cylindrical part 171 is about 16 mm, an inner diameter thereof is about 10 mm, a length thereof is 40-50 mm and a diameter of the through-hole 170 is slightly shorter than a thickness of the cylindrical part 171.

Figure 8A:
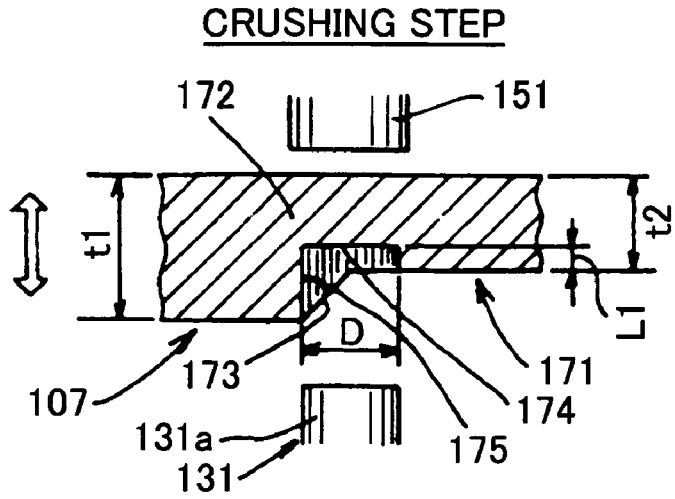
FIGS. 8(*a*)-8(*c*) are sectional views showing machining steps.
Figure 8B:
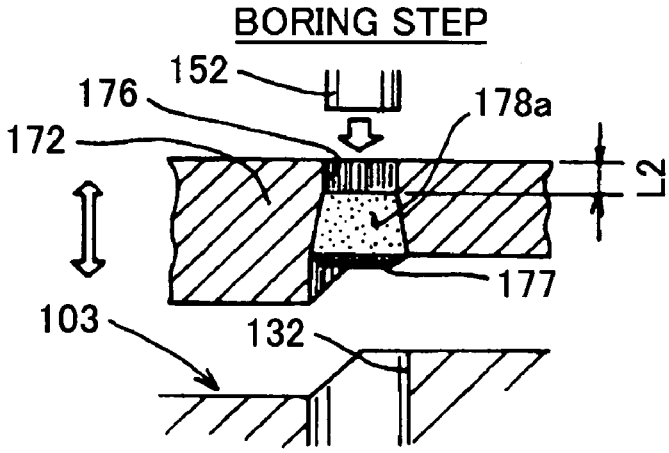
Figure 8C:
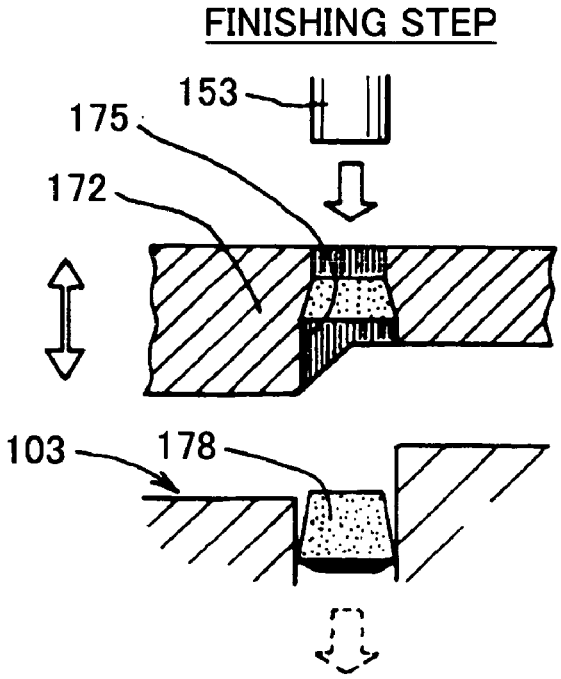

FIGS. 8(*a*)-8(*c*) show the machining steps of boring the through-hole. In a crushing step shown in FIG. 8(*a*), a crushing punch 131 is relatively driven into an outer face of the circumferential wall 172 toward an axis of the cylindrical part 171. In this example, the work piece 107 is moved toward the crushing punch 131 so as to make the punch 131 drive into the work piece 107. With this action, a concave 174, which corresponds to the slope part 173, is formed in the outer face of the circumferential wall 172. An diameter D of the concave 174 is slightly greater than that of the through-hole 170.

An upper end of the crushing punch 131 is formed into a short columnar shaft 131*a*, and the end face is a flat face perpendicular to an axial line of the shaft 131*a*.

An inner circumferential face of the concave 174 is a sheared face 175, which is formed by driving the shaft 131*a* into the outer face of the circumferential wall 172.

When the shaft 131*a* of the crushing punch 131 is driven into the circumferential wall 172, a holding punch 151 contacts the inner face of the circumferential wall 172. The holding punch 151 prevents the inner face of circumferential wall 172 from expanding inward.

In a boring step shown in FIG. 8(*b*), a primary punch 152 is positioned at a prescribed position in the cylindrical part 171, which corresponds to the concave 174, and radially outwardly driven into the inner face of the circumferential wall 172, so that a bottomed hole 176 is formed on the opposite side of the concave 174. When the primary punch 152 is driven into the circumferential wall 172, a die block 103 supports the work piece 107.

A diameter of the primary punch 152 is slightly smaller than that of the concave 174.

An inner circumferential face of the bottomed hole 176 is also a sheared face sheared by the primary punch 176.

A bottom 177 of a part 178*a* of the cylindrical wall 172, which has been pushed inward, enters the concave 174 and slightly projects outward from an edge of the concave 174 on the lower side of the slope part 173.

In a finishing step shown in FIG. 8(*c*), a secondary punch 153 is radially outwardly driven into the bottomed hole 176 of the circumferential wall 172 so as to outwardly push a bottom of the hole 176 or the part 178*a*, so that the through-hole 170 is opened.

When the secondary punch 153 is driven into the bottomed hole 176, the die block 103 supports the work piece 107.

Figures 9A, 9B, 9C:
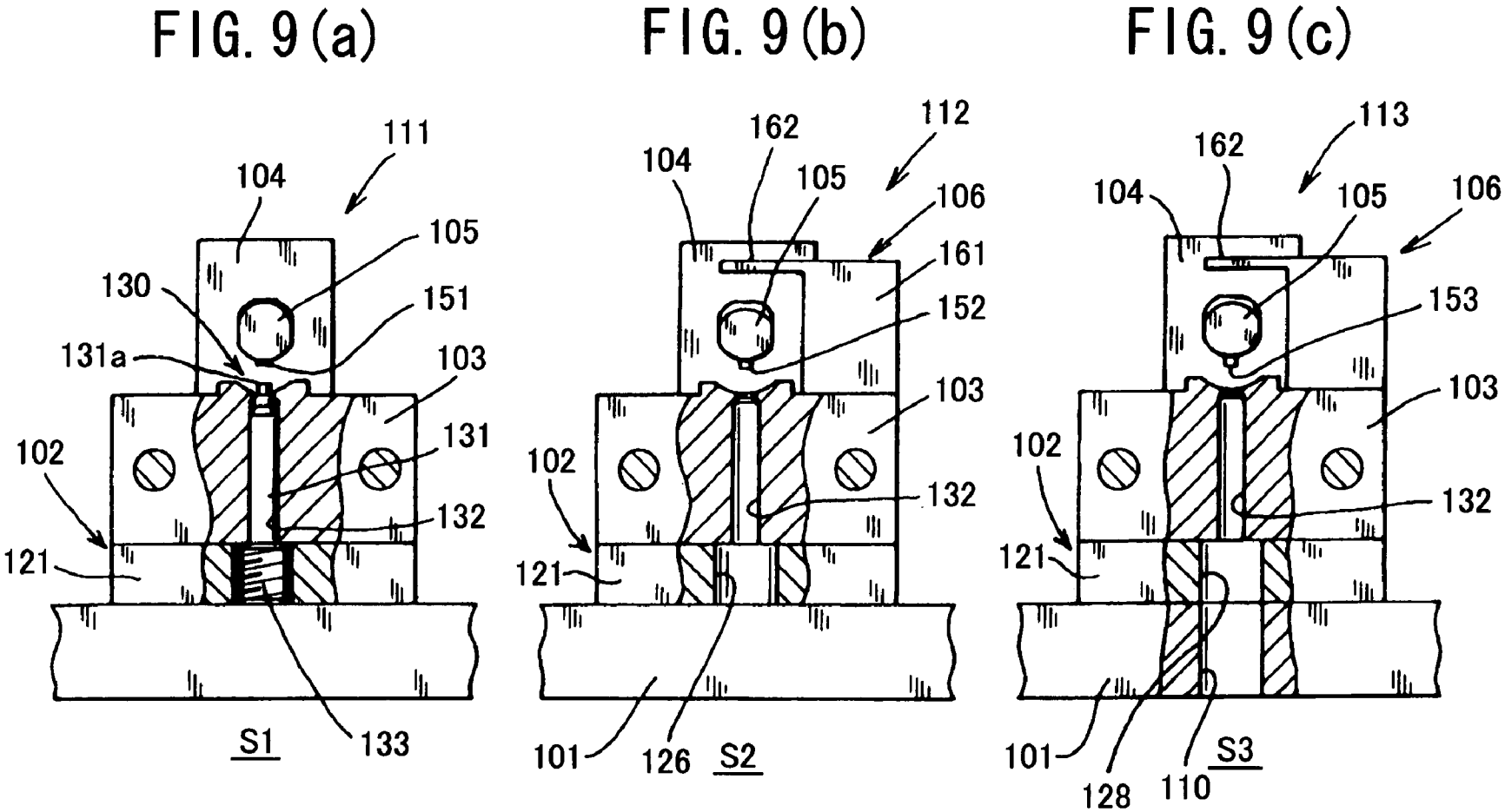
FIGS. 9(*a*)-9(*c*) are explanation views of stations for the steps shown in FIGS. 8(*a*)-8(*c*)

FIGS. 9(*a*)-9(*c*) respectively show a first station S1 for performing the crushing step, a second station S2 for performing the boring step and a third station S3 for performing the finishing step. Boring units 111, 112 and 123 are respectively provided to the stations S1, S2 and S3.

Each of the boring units 111, 112 and 123 includes the die block 103 and a metal core 105. The metal cores 105 of the boring units 111, 112 and 123 respectively have the punches 151, 152 and 153, which are projected downward.

In the stations S2 and S3, the work pieces 107 are set to make the cylindrical parts 172 cover the metal cores 105, which are located above the die blocks 103. Next, the metal cores 105 are moved downward, and the work pieces 107 are supported by the die block 103. Then, the punches 152 and 153 are driven into the inner faces of the circumferential walls 172 of the cylindrical parts 171 of the work pieces 107.

Note that, in the station S1 for the crushing step, the holding punch 151 merely supports the inner face of the cylindrical part 171 of the work piece 107. The holding punch 151 is not driven into the circumferential walls 172. The crushing punch 131 forms the concave 174, which corresponds to the holding punch 151, in the outer face of the circumferential walls 172.

Figure 10:
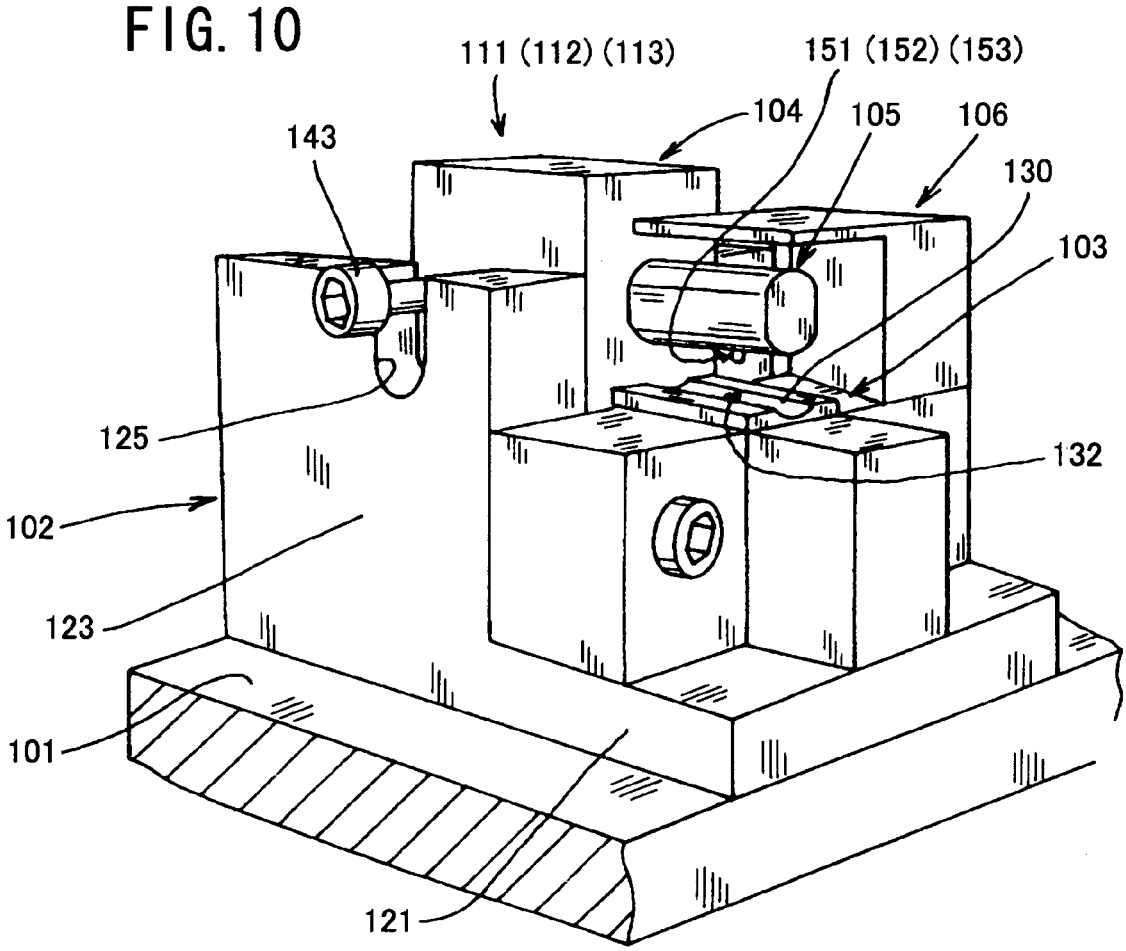
FIG. 10 is a perspective view of a boring unit.
Figure 11:
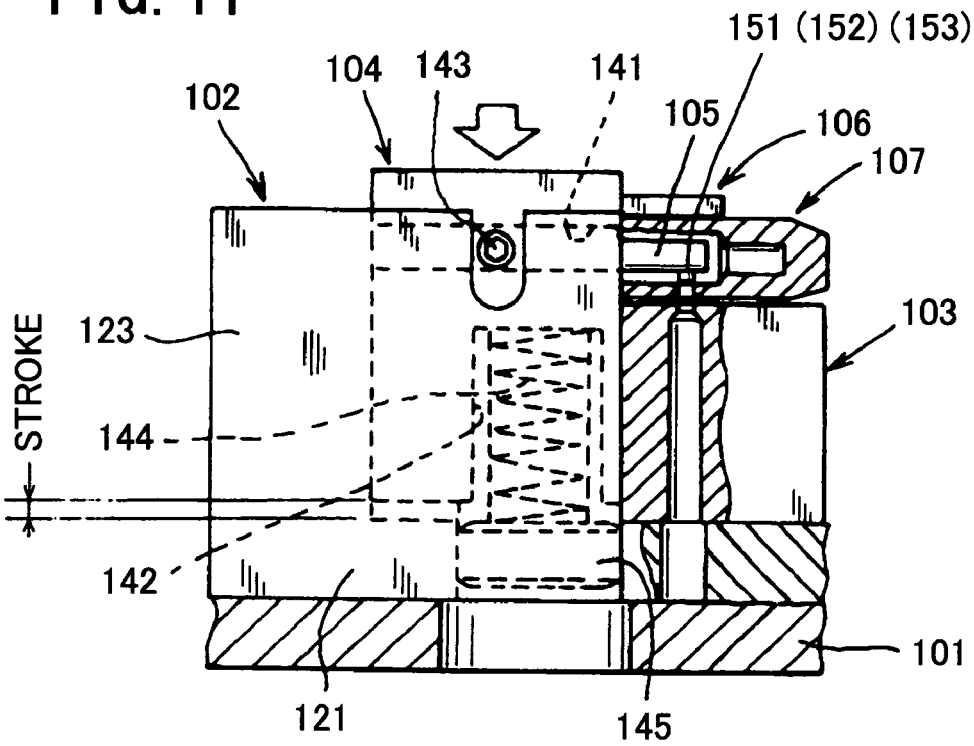
FIG. 11 is a left side view of the unit.
Figure 12:
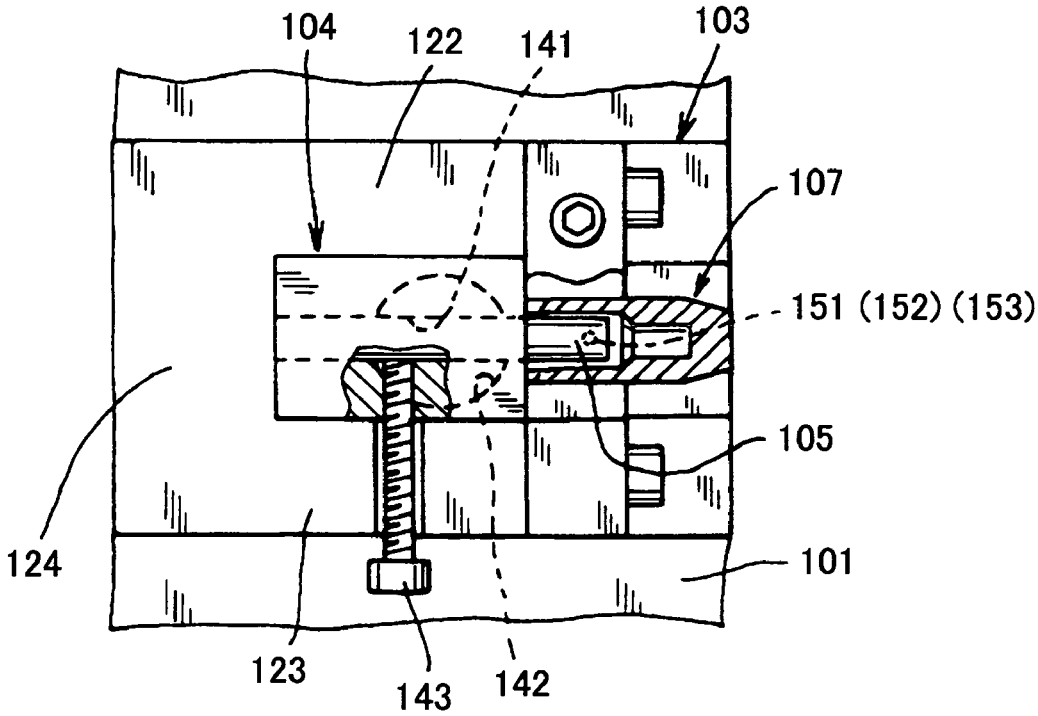
FIG. 12 is a plan view of the unit.

As shown in FIGS. 10-12, support bases 102 of the boring units 111, 112 and 113 are fixed on a common base 101, and the die block 103, the metal core 105, etc. are provided on each support base 102.

In each support base 102, a right wall plate 122 and a left wall plate 123 are vertically projected from a rear part of a bottom plate 121, and rear ends of the wall plates 122 and 123 are connected by a rear wall plate 124.

Each die block 103 is provided to a front part of the bottom plate 121 of each support base 102 and connected to the wall plates 122 and 123 by bolts.

Figure 17:
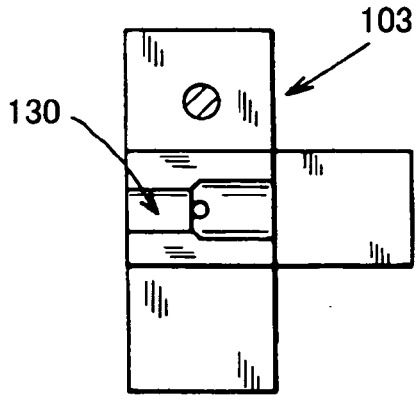
FIG. 17 is a plan view of a die block.
Figure 18:
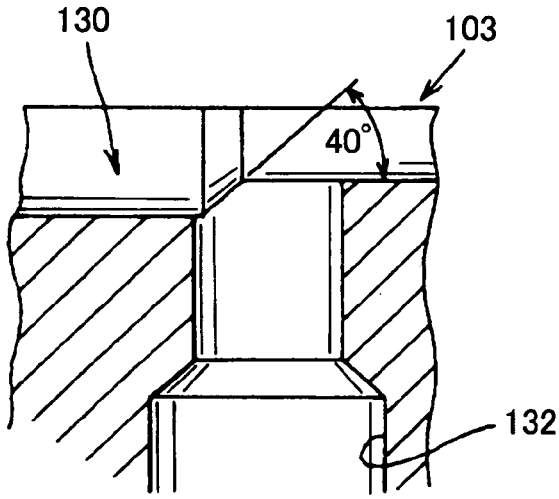
FIG. 18 is a partial sectional view of the die block including an upper part of a hole.

A shallow groove 130 is formed in a center part of an upper face of each die block 103 and extended in an anteroposterior direction so as to stably receive the work piece 107 (see FIGS. 17 and 18).

A vertical hole 132, in which inner diameter of an upper end is smaller than that of a lower part, is formed in each die block 103. A position of the vertical hole 132 corresponds to the position of through-hole 170 to be bored.

In FIG. 9(*a*), the crushing punch 131 is inserted in the vertical hole 132 of the die block 103 of the first station S1. An upper edge of the crushing punch 131 is angulated to correspond to a shape of the concave 174 of the work piece 107, and the upper end of the crushing punch 131 is upwardly projected from the groove 130. The projected length corresponds to a depth of the concave 174.

As described above, the upper end of the crushing punch 131 is formed into the short columnar shaft 131*a*, and the end face is the flat face perpendicular to the axial line of the shaft 131*a*.

The crushing punch 131 is held by a holder 133, which is provided to the bottom plate 121 of the support base 102. The holder 133 prohibits the crushing punch 131 to move downward.

As shown in FIGS. 10 and 12, the elevating block 104 is accommodated in a space enclosed by the wall plates 122, 123 and 124 of the support base 102. The elevating block 104 can be moved upward and downward in the space.

A core hole 141 is formed in an upper part of the elevating block 104 and extended in the anteroposterior direction. The rod-shaped metal core 105 is inserted in the core hole 141, and the front end part of the metal core 105 is outwardly projected from the core hole 141. The projected part of the metal core 105, which is projected from the elevating block 104, is located immediately above the groove 130 of the die block 103.

A spring hole 142 is formed in an bottom face of the elevating block 104, and a spring 144 is accommodated in the spring hole 142 so that the elevating block 104 is always biased upward by the spring 144. When the elevating block 104 is located at the uppermost position, the elevating block 104 can be downwardly moved a prescribed distance, which is defined by a clearance between the bottom face of the elevating block 104 and the bottom plate 121 of the support base 102. The uppermost position of the elevating block 104 is limited by a proper means (not shown), e.g., stopper.

The spring 144 is held by an adjusting table 145, which is screwed with the bottom plate 121 of the support base 102. Pressure of the spring 144 can be adjusted by tightening and slackening the adjusting table 145.

A crank bolt 143 is provided to a side face of the elevating block 104, and its front end reaches the core hole 141, and the metal core 105 can be fixed by tightening the crank bolt 143.

The punches 151, 152 and 153, which are respectively provided to and projected from the metal cores 105, are respectively inserted in the cylindrical parts 171 of the work pieces 107, and open ends of the cylindrical parts 171 respectively contact the elevating blocks 104. In this state, the punches 151, 152 and 153 respectively correspond to boring positions of the work pieces 107, at which the through-holes 170 will be bored.

The base 101 is fixed to a base board (not shown) of a press mechanism. The elevating blocks 104 are simultaneously moved downward from initial positions, by downwardly moving a ram (not shown) of the press mechanism, against elasticity of the springs 144; the elevating blocks 104 are simultaneously moved upward to the initial positions, by upwardly moving the ram, by elasticity of the springs 144.

The die blocks 103 of the second and the third stations S2 and S3 respectively have strippers 106.

Each stripper 106 includes a contact plate 162, which is extended from a member 161 fixed to the upper face of the die block 103 and which covers the metal core 105.

Figure 13:
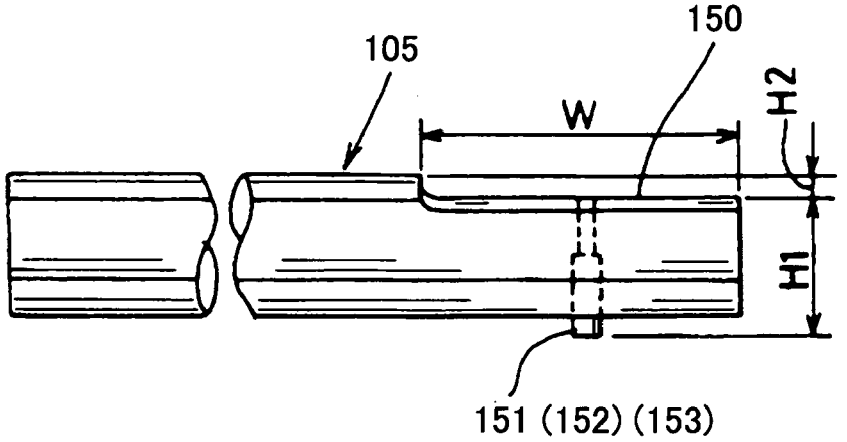
FIG. 13 is a side view of a meal core and a punch.
Figure 14:
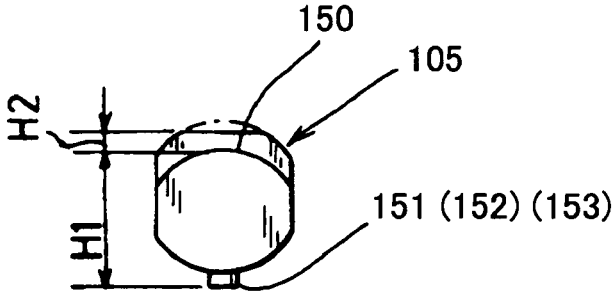
FIG. 14 is a front view of the metal core and the punch.
Figure 15:
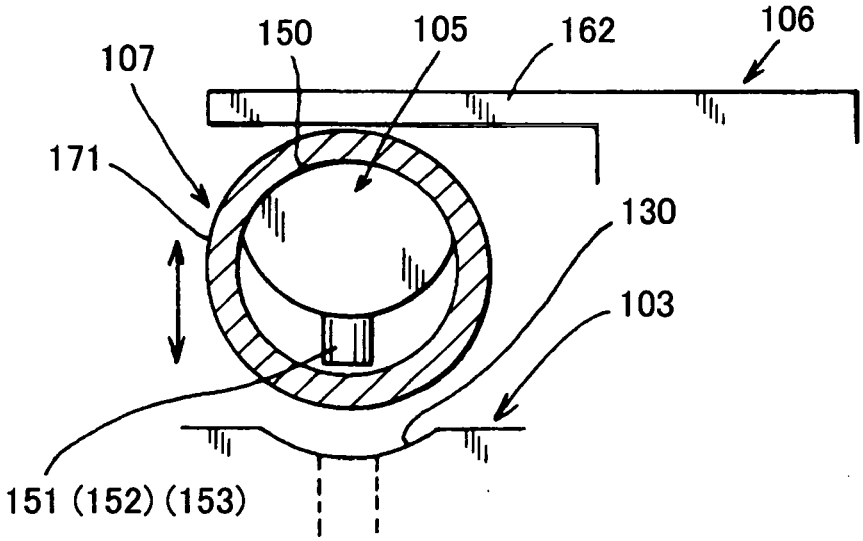
FIG. 15 is an explanation view showing a state, in which a work piece contacts a stripper.

As shown in FIG. 13, a part W of the metal core 105 will be inserted into the cylindrical part 171 of the work piece 107. A cut section 150 is formed in the metal core 105 by cutting the part W. As shown in FIGS. 14 and 15, the cut section 150 is are formed into an arc-shape along the inner circumferential face of the cylindrical part 171 of the work piece 107.

The holding punch 151 of the first station S1, the primary punch 152 of the second station S2 and the secondary punch 153 of the third station S3 are respectively projected downward from the metal cores 105. The punches 151, 152 and 153 are located immediately above the vertical holes 132 of the die block 103.

Lower end edges of the punches 151, 152 and 153 are angulated.

Lengths of the punches 151, 152 and 153 are different. As shown in FIGS. 13 and 14, lengths H1 from the cut sections 150 to the lower ends of the punches 151, 152 and 153 are mutually slightly different. The length H1 must be designed to allow the metal core 105 including the punch to enter the cylindrical part 171 of the work piece 107. A depth H2 of the cut section 150 of the metal core 105 is increased with elongating the punch.

As described above, when the shaft 131*a* of the crushing punch 131 is driven into the circumferential wall 172 to form the concave 174, the holding punch 151 of the first station S1 contacts the inner face of the circumferential wall 172. The holding punch 151 prevents the inner face of circumferential wall 172 from partially expanding inward.

If an outer circumferential face of the metal core 105 contacts and holds the inner face of the circumferential wall 172 corresponding to the concave 174, the holding punch 151 may be omitted.

As shown in FIG. 19, a small step-shaped part 180 is formed in the inner face of the cylindrical part 171 of the work piece 107, so the outer circumferential face of the metal core 105 cannot contact the inner face thereof, which corresponds to the through-hole 170 to be bored. Thus, the length of the holding punch 151 projected from the metal core 105 is equal to a height of the step-shaped part 180.

A diameter of the lower end of the holding punch 151 is greater than a diameter of the concave 174, so that a holding area of the holding punch 151 can securely hold the he inner face of the circumferential wall 172 corresponding to the concave 174 to be formed.

A diameter of the primary punch 152 of the second station S2 is slightly smaller than the diameter of the concave 174, and the length is about a half of the thickness of the circumferential wall 172.

A diameter of the secondary punch 153 of the third station S3 is slightly smaller than the diameter of the primary punch 152. Namely, the diameter is slightly shorter than a diameter of the bottomed hole 176 of the work piece 107. The length of the secondary punch 153 designed to punch out the bottom of the hole 176. The lower end of the secondary punch 153 need not reach the bottom of the concave 174 of the work piece 107. By driving the secondary punch 153 close to the bottom of the concave 174, the through-hole 170 can be bored.

The diameter D of the concave 174 must be greater than that of the secondary punch 153, but it depends on the diameter of the secondary punch 153, a material and the thickness of the work piece 107, a depth of the bottomed hole 176, etc. The inventor have studied and found that the suitable diameter D is determined on the basis of the following formula:

(Diameter D of the concave)=(Diameter of the secondary punch)+[(Thickness of the work piece)×(5−12%)×2]

If the diameter D of the concave 174 is deviated from the value given by the above formula, burrs are formed along the edge of the through-hole 170.

In the first station S1, the cylindrical part 171 of the work piece 107 covers the metal core 105, and the open end of the cylindrical part contacts the elevating block 104. In this state, the elevating block 104 is moved downward. The holding punch 151 attached to the metal core 105 holds the inner circumferential face of the wall 172 (see FIG. 16(*a*)). Simultaneously, the shaft 131*a* of the crushing punch 131 is driven into the prescribed position of the work piece 107, at which the through-hole 170 will be bored, so as to form the concave 174 (see FIG. 8(*a*)).

Since the edge of the shaft 131*a* of the crushing punch 131 is angulated, the inner circumferential face of the concave 174 is the sheared face. Further, the end face of the shaft 131*a* is the flat face perpendicular to the axial line thereof, so that the inner bottom face of the concave 174 is formed into a flat face.

The work piece 107, in which the concave 174 has been formed in the first station S1, is detached from the metal core 105 of the first station S1. Then, the work piece 107, whose concave 174 is headed down, is set in the second station S2. In the second station S2, the cylindrical part 171 of the work piece 107 covers the metal core 105, and the open end of the cylindrical part contacts the elevating block 104. In this state, the elevating block 104 is moved downward.

Figure 16A:
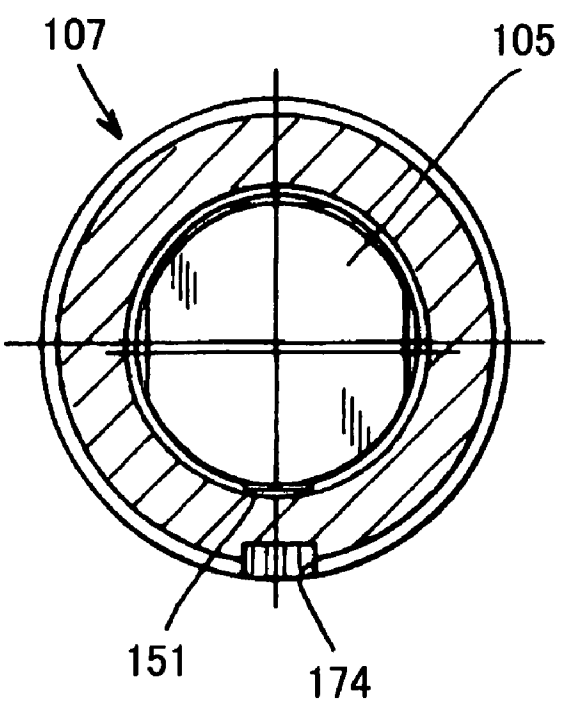
FIGS. 16(*a*)-16(*c*) are explanation views showing states of driving the punch into a circular wall of a cylindrical part in each station.
Figure 16B:
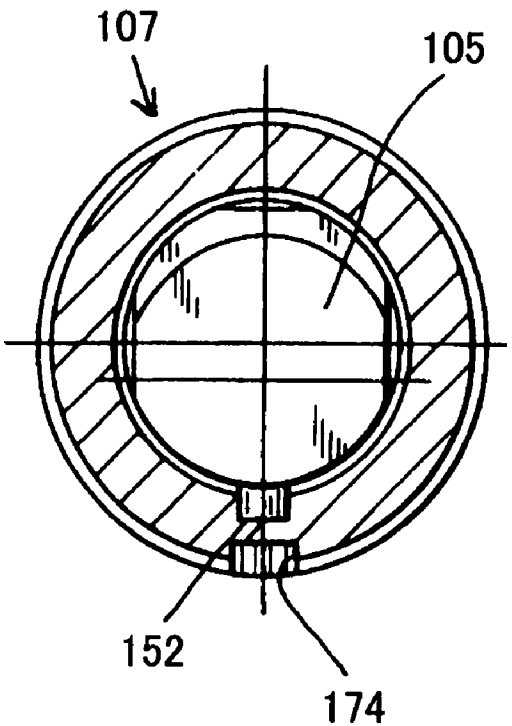
Figure 16C:
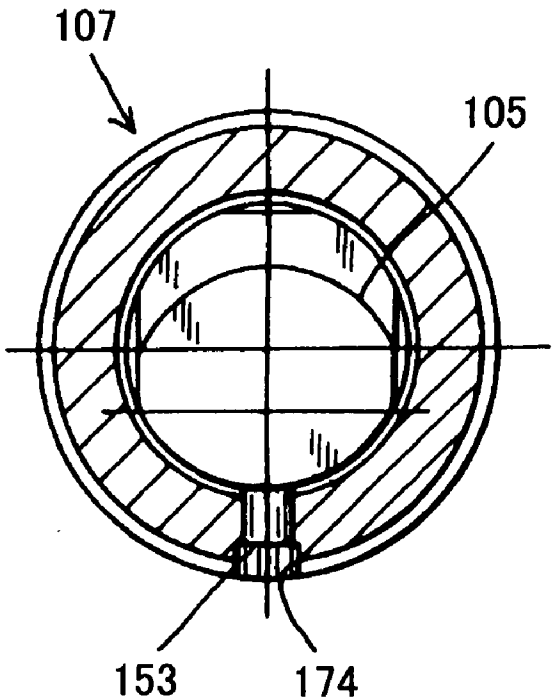

The primary punch 152 is driven into the prescribed position of the inner face of the circumferential wall 172 (see FIG. 16(*b*)) so as to form the bottomed hole 176 (see FIG. 8(*b*)).

The bottom 177 of the part 178*a* enters the concave 174 and slightly projected from the edge of the concave 174 on the lower side of the slope part 173. The projected part 177 enters the vertical hole 132 of the die block 103.

The inner circumferential face of the bottomed hole 175 is the sheared face.

When the elevating block 104 is upwardly moved to the initial position, the work piece 107 contacts the contact plate 162 of the stripper 106, and the primary punch 152 comes out from the bottomed hole 176. Therefore, the work piece 107 can be detached from the metal core 105.

The work piece 107, in which the bottomed hole 176 has been formed in the second station S2, is detached from the metal core 105 of the second station S2. Then, the work piece 107, whose bottomed hole 176 is headed up, is set in the third station S3. In the third station S3, the cylindrical part 171 of the work piece 107 covers the metal core 105, and the open end of the cylindrical part contacts the elevating block 104. In this state, the elevating block 104 is moved downward (see FIG. 16(*c*)).

The secondary punch 153 is driven into the bottomed hole 176 to open the through-hole 170 (see FIG. 8(*c*)).

As shown in FIG. 9(*c*), the scrap 178 is discharged outside via the hole 132 of the die block 103, the hole 128 of the support base 102 and the hole 110 of the base 101.

When the elevating block 104 is upwardly moved to the initial position, the work piece 107 contacts the contact plate 162 of the stripper 106, and the secondary punch 153 comes out from the work piece 107. Therefore, the work piece 107 can be detached from the metal core 105.

When the bottom of the bottomed hole 176 is punched out, the broken part, which has been punched out by the secondary punch 153, reaches the sheared face 175 of the concave 174, so that no material of the work piece 107 is pulled outward from the sheared face 175. Therefore, no burrs are formed along the edge of the through-hole 170.

By forming no burrs, a finishing or polishing step, which is an essential step of the conventional method, can be omitted.

Unlike the conventional method using electric spark means, the through-hole 170 can be formed in a short time, so that the machining efficiency can be improved.

Since the concave 174, whose diameter is slightly greater than that of the through-hole 170 to be bored, is previously formed on the opposite side of the secondary punch 153, the length of the secondary punch 153 can be shorter on the basis of the depth of the concave 174 so that a break of the secondary punch 153 can be prevented, and a life span thereof can be made longer.

Since the inner bottom face of the concave 174 is flat, no step-shaped part is formed near the prescribed position, at which the through-hole 170 will be formed. Therefore, no biased load is applied to the punch, so that the punch is not damaged.

The work pieces 107 may be manually transferred between the stations S1, S2 and S3. If they are transferred by a transfer device, the machining efficiency can be highly improved.

Example 2

Another example will be explained.

An outer diameter of the cylindrical part 171 is 16 mm, an inner diameter thereof is 10 mm, a length thereof is 40 mm.

In FIG. 8(*a*), the circular wall 172 of the cylindrical part 171 is divided into a thicker part, whose thickness is t1, and a thinner part, whose thickness is t2, by the slope part 173. The thickness t1 is 3 mm; the thickness t2 is 2.5 mm; the diameter D of the concave 174, which is formed by the crushing punch 131, is 2.2 mm; and a depth L1 of a shallow part of the concave 174 is 0.5 mm.

In FIG. 8(*b*), the diameter of the primary punch 152 is 1.75 mm; and a depth L2 of the bottomed hole 176, which is formed by the primary punch 152, is 0.9 mm.

In FIG. 8(*c*), the diameter of the secondary punch 153 is 1.70 mm. The through-hole 170 can be bored without forming burrs.

In the above described examples, the die blocks 103 of the stations S1, S2 and S3 have the same shape, so that they can be compatibly used. The vertical through-holes 132 of the die blocks 103 have the same shape, but the die block 103 of the second station S2 may have a concave for accommodating a material of the work piece 107, which is projected from the edge of the concave 174 by driving the primary punch 152 into the inner face of the circumferential face 172, instead of the vertical through-hole 132.

Further, the vertical through-hole 132 of the die block 103 of the third station S3 acts as the discharge hole for removing the scrap 178, so its shape is not limited.

In the present invention, the through-hole 170 may be bored at the prescribed position corresponding to the concave 174 in one operation after forming the concave 174 in the outer face of the cylindrical part 171 of the work piece 107. In this case, the machining efficiency can be improved by omitting one step. Note that, if the cylindrical part 171 is thick, load applied to the punch is great so that the punch may be damaged.

In the above described embodiments, the through-holes to be formed by the method and the machine of the present invention are circular through-holes. But, the present invention is not limited to the embodiments, so the present invention can be applied to form elliptical through-holes, oval through-holes, etc.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of forming a through-hole in a circumferential wall of a tubular part of a metal work piece, comprising the steps of:

setting the metal work piece at a die;

inserting a punch, which is fixed to and projected from a cantilever rod-shaped metal core whose front part is thinner than a rear part thereof so as to allow the punch to move toward the die in the tubular part and the step-shaped border between the front part and the rear part is rounded, and the length of the punch projected from the metal core is shorter than a thickness of the circumferential wall;

moving the punch into contact with the interior of said metal work piece by a force from an elevating block which receives the metal core and is movable in a punching direction, simultaneously cutting part of the way through the work piece and causing the metal core of the punch to become elastically bent;

moving the punch further to fracture the remainder of the through-hole, wherein the elastic bend of the metal core is relieved causing the scrap to be forced out of the through-hole and be removed in conjunction with a sucking in a discharge hole.

2. The method according to claim 1, wherein a concavity, whose diameter is slightly greater than that of the through-hole, is formed, at a predetermined position of boring the through-hole, in an outer face of the circumferential wall prior to boring the through-hole, and a break reaching an edge of the concavity is formed by driving the punch into the inner face of the circumferential wall.

3. The method according to claim 1, wherein the punch is relatively pressed and moved toward the die by an elastic force pressing the elevating block.

* * * * *